US010119362B2

(12) United States Patent
Fripp et al.

(10) Patent No.: US 10,119,362 B2
(45) Date of Patent: Nov. 6, 2018

(54) FLOW CONTROL DEVICE FOR CONTROLLING FLOW BASED ON FLUID PHASE

(71) Applicant: HALLIBURTON ENERGY SERVICES, INC., Houston, TX (US)

(72) Inventors: Michael L. Fripp, Carrollton, TX (US); John C. Gano, Carrollton, TX (US); Zachary R. Murphree, Dallas, TX (US)

(73) Assignee: Halliburton Energy Services Inc., Houston, TX (US)

( * ) Notice: Subject to any disclaimer, the term of this patent is extended or adjusted under 35 U.S.C. 154(b) by 623 days.

(21) Appl. No.: 14/378,986

(22) PCT Filed: Aug. 16, 2013

(86) PCT No.: PCT/US2013/055365

§ 371 (c)(1),
(2) Date: Aug. 15, 2014

(87) PCT Pub. No.: WO2015/023294

PCT Pub. Date: Feb. 19, 2015

(65) Prior Publication Data

US 2015/0053420 A1 Feb. 26, 2015

(51) Int. Cl.
*E21B 34/08* (2006.01)
*E21B 43/12* (2006.01)
(Continued)

(52) U.S. Cl.
CPC ..... *E21B 34/06* (2013.01); *E21B 43/24* (2013.01); *F16K 31/002* (2013.01); *Y10T 137/0324* (2015.04); *Y10T 137/7737* (2015.04)

(58) Field of Classification Search
CPC ..... E21B 34/08; E21B 43/12; F16K 31/002
See application file for complete search history.

(56) References Cited

U.S. PATENT DOCUMENTS 2,145,774 A * 1/1939 Muffly ..... F25C 1/12 137/110
2,778,573 A * 1/1957 Morgan ..... F16T 1/10 236/56

(Continued)

OTHER PUBLICATIONS

International Search Report dated May 19, 2014 for PCT Patent Application No. PCT/US2013/055365, 3 pages.
Canadian Office Action dated Nov. 1, 2016 in corresponding Canadian Application No. 2,917,675.

*Primary Examiner* — Kipp C Wallace
(74) *Attorney, Agent, or Firm* — Locke Lord LLP; Christopher J. Cillie; Daniel Nguyen

(57) ABSTRACT

A flow control device can include water in a chamber, the chamber having a variable volume, a flow restricting member which displaces in response to a change in the chamber volume, and a biasing device which influences a pressure in the chamber. A method of controlling flow of steam in a well can include providing a flow control device which varies a resistance to flow in the well, the flow control device including a chamber having a variable volume, water disposed in the chamber, and a biasing device. The biasing device influences the chamber volume. Another flow control device can include water in a chamber, the chamber having a variable volume, a flow restricting member which displaces in response to a change in the chamber volume, and a biasing device which reduces a boiling point of the water in the chamber.

6 Claims, 12 Drawing Sheets

(51) Int. Cl.

| | |
|---|---|
| ***E21B 34/06*** | (2006.01) |
| ***F16K 31/00*** | (2006.01) |
| ***E21B 43/24*** | (2006.01) |

(56) References Cited

U.S. PATENT DOCUMENTS

| | | | | | |
|---|---|---|---|---|---|
| 4,560,105 | A * | 12/1985 | Jiandani | F16T 1/10 | 236/58 |
| 4,679,727 | A * | 7/1987 | Alesson | F16T 1/10 | 236/56 |
| 5,280,874 | A * | 1/1994 | Zink | F16K 27/07 | 251/144 |
| 5,476,525 | A * | 12/1995 | Bekedam | B01D 19/0005 | 122/441 |
| 6,622,794 | B2 * | 9/2003 | Zisk, Jr. | E21B 34/066 | 166/205 |
| 7,296,633 | B2 | 11/2007 | Bode et al. | | |
| 7,866,400 | B2 * | 1/2011 | Steele | E21B 34/06 | 166/319 |
| 8,496,059 | B2 * | 7/2013 | Schultz | E21B 34/08 | 166/263 |
| 2005/0072578 | A1 * | 4/2005 | Steele | E21B 34/08 | 166/386 |
| 2009/0250224 | A1 | 10/2009 | Wright et al. | | |
| 2013/0192833 | A1 * | 8/2013 | Gano | F16K 31/002 | 166/302 |
| 2014/0209822 | A1 * | 7/2014 | Mathiesen | E21B 34/08 | 251/11 |

* cited by examiner

FLOW CONTROL DEVICE FOR CONTROLLING FLOW BASED ON FLUID PHASE

CROSS-REFERENCE TO RELATED APPLICATION

This application is a national stage under 35 USC 371 of International Application No. PCT/US13/55365, filed on 16 Aug. 2013. The entire disclosure of this prior application is incorporated herein by this reference.

TECHNICAL FIELD

This disclosure relates generally to equipment utilized and operations performed in conjunction with a subterranean well and, in one example described below, more particularly provides a flow control device for controlling flow based on fluid phase.

BACKGROUND

Phase control valves can be used, for example, to prevent steam breakthrough in steam flood operations, and/or to prevent injection of liquid water. Unfortunately, such phase control valves can be expensive to construct or difficult to tailor for specific well conditions. Therefore, it will be appreciated that improvements are continually needed in the arts of constructing and utilizing flow control devices for controlling flow based on fluid phase.

DETAILED DESCRIPTION

Figure 1A:
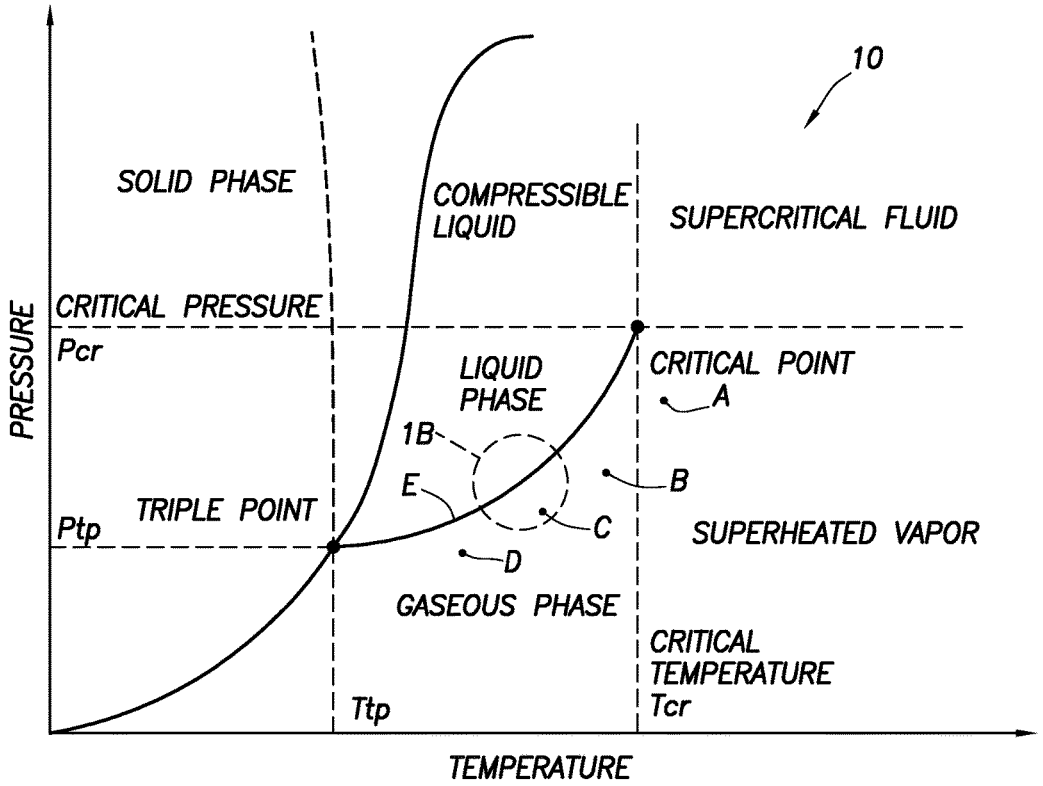
FIGS. 1A & B are a phase diagram for water, FIG. 1B depicting an enlarged detail of a portion of FIG. 1A.

Representatively illustrated in FIG. 1A is the well-known phase diagram 10 for water. Water is used herein as an example of a common fluid which is injected into and produced from subterranean formations. In particular, thermally-assisted hydrocarbon recovery methods frequently use injection of water in the form of steam to heat a surrounding formation, and then the water is produced from the formation in liquid form.

Thus, the properties and problems associated with steam injection and subsequent liquid water production in formations are fairly well known in the art. However, it should be clearly understood that the principles of the present disclosure are not limited in any way to the use of water as the injected and/or produced fluid.

Examples of other suitable fluids include hydrocarbons such as naphtha, kerosene, and gasoline, and liquefied petroleum gas products, such as ethane, propane, and butane. Such materials may be employed in miscible slug tertiary recovery processes or in enriched gas miscible methods known in the art.

Additional suitable fluids include surfactants such as soaps, soap-like substances, solvents, colloids, or electrolytes. Such fluids may be used for or in conjunction with micellar solution flooding.

Further suitable fluids include polymers such as polysaccharides, polyacrylamides, and so forth. Such fluids may be used to improve sweep efficiency by reducing mobility ratio.

Therefore, it will be appreciated that any fluid or combination of fluids may be used in addition, or as an alternative, to use of water. Accordingly, the term "fluid" as used herein should be understood to include a single fluid or a combination of fluids, in liquid and/or gaseous phase.

As discussed above, the water is typically injected into the formation after the water has been heated sufficiently so that it is in its gaseous phase. The water could be in the form of superheated vapor (as shown at point A in FIG. 1A) above its critical temperature $T_{cr}$, or in the form of a lower temperature gas (as shown at points B, C & D in FIG. 1A) below the critical temperature, but typically above the triple point temperature $T_{tp}$.

In some examples described below, it is desired that the water produced from the formation be in its liquid phase, so that the water changes phase within the formation prior to being produced from the formation. In this manner, damage to the formation, production of fines from the formation, erosion of production equipment, etc., can be substantially reduced or even eliminated.

However, it is also desired that this phase change take place just prior to production of the water from the formation, so that heat energy transfer from the steam is more consistently applied to the formation, and while the steam is more mobile in the formation, prior to changing to the liquid phase. Thus, in the phase diagram of FIG. 1A, the water produced from the formation would desirably be at a temperature and pressure somewhere along the phase change curve E or, to ensure that production of steam is prevented, just above the phase change curve.

Figure 1B:
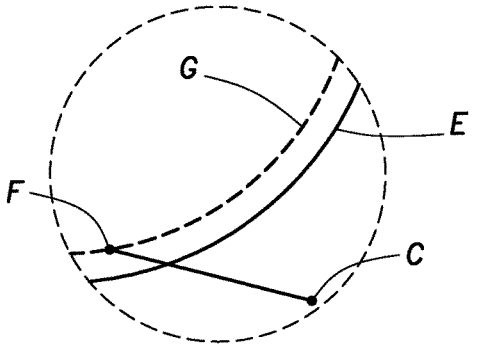

Referring additionally now to FIG. 1B, an enlarged scale detail of a portion of FIG. 1A is representatively illustrated. This detail depicts a fundamental feature of a method which can embody principles of the present disclosure.

Specifically, the detail depicts an example in which flow of the fluid (in this example, water) is controlled so that it is injected into the formation at a pressure and temperature corresponding to point C in the gaseous phase, and is produced from the formation at a pressure and temperature corresponding to point F in the liquid phase. Point F is on a curve G which is just above, and generally parallel to, the phase change curve E. In other examples, the fluid could be injected at any of the other points A, B, D in FIG. 1A, and produced at any other point along the curve G.

Preferably, the fluid is produced at a point on the phase diagram which is on the curve G, or at least above curve G. Thus, the curve G represents an ideal production curve representing a desired phase relationship or phase state at the time of production. Stated differently, curve G represents a maximum temperature and minimum pressure phase relationship relative to the liquid/gas phase change curve E.

Note that such phase-based flow control of the fluid cannot be based solely on temperature, since at a same temperature the fluid could be a gas or a liquid, and the flow control cannot be based solely on pressure, since at a same pressure the fluid could also be a gas or a liquid. Instead, this disclosure describes various ways in which the flow control is based on the phase of the fluid.

In examples described below, various flow control devices can be used in well systems to obtain a desired injection of steam and production of water, but it should be understood that this disclosure is not limited to these examples. Various other benefits can be derived from the principles described below. For example, the flow control devices can be used to provide a desired quantitative distribution of steam along an injection wellbore, a desired quantitative distribution of water along a production wellbore, a desired temperature distribution in a formation, a desired steam front profile in the formation, etc.

Figure 2:
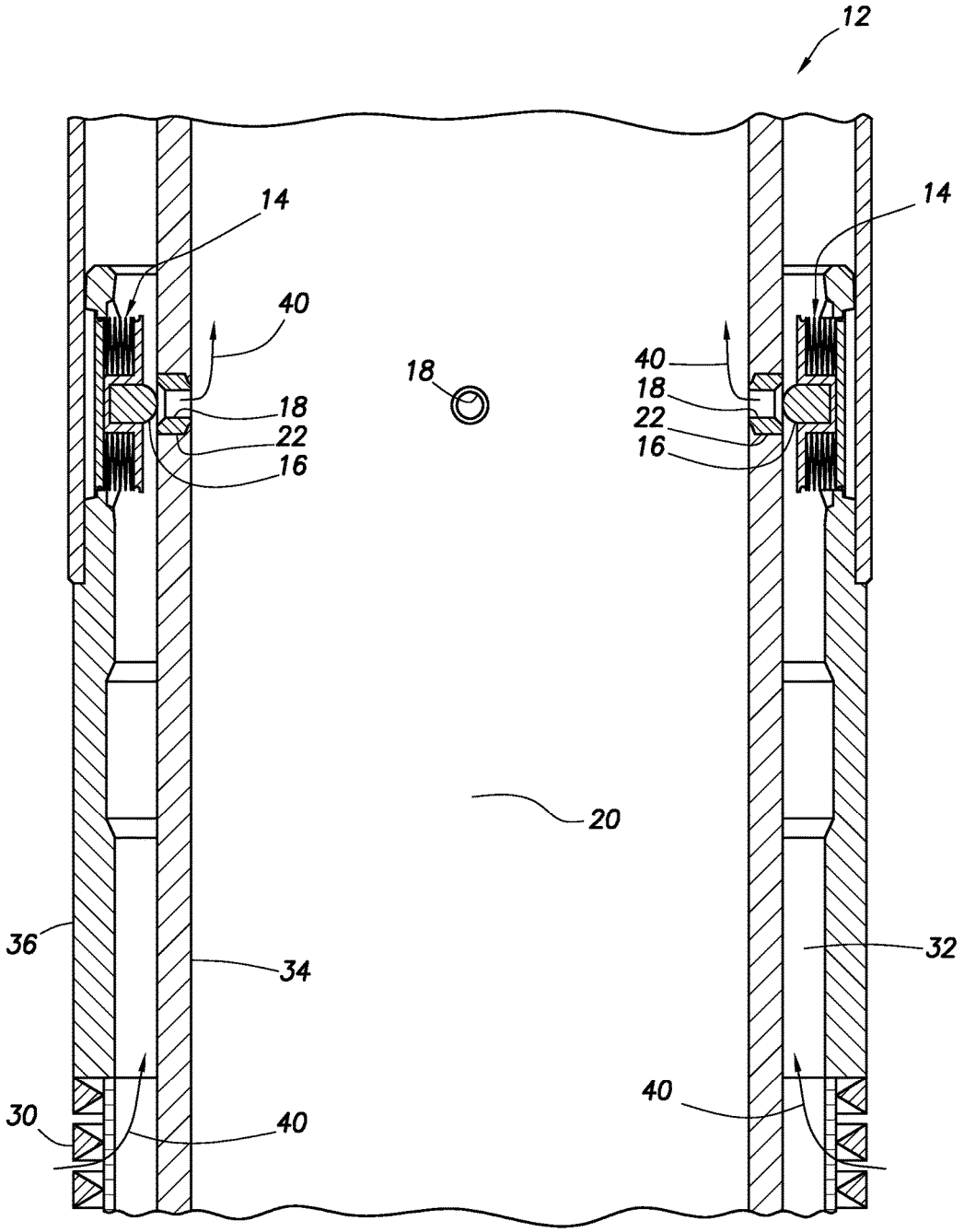
FIG. 2 is a representative cross-sectional view of a flow control device which can embody principles of this disclosure.

Representatively illustrated in FIG. 2 is a flow control device 12 which can embody principles of this disclosure. However, it should be clearly understood that the flow control device 12 of FIG. 2 is merely one example of an application of the principles of this disclosure in practice, and a wide variety of other examples are possible. Therefore, the scope of this disclosure is not limited at all to the details of the flow control device 12 described herein and/or depicted in the drawings.

In the FIG. 2 example, the flow control device 12 includes multiple actuators 14 which control displacement of respective flow restricting members 16 relative to openings 18. Each opening 18 is provided with a seat 22 for sealing engagement with the respective member 16, so that flow into an internal longitudinally extending flow passage 20 can be prevented.

However, it is not necessary for the member 16 to sealingly engage the seat 22, since in some examples it may be sufficient for the member to substantially choke flow through the opening 18, without entirely preventing such flow. Although multiple sets of actuators 14, members 16, openings 18, etc., are depicted in FIG. 2, any number (including only one) of set(s) may be used, and the sets can be arranged in any configuration.

In the FIG. 2 example, a fluid 40 enters the flow control device 12 from an exterior thereof via a filter or well screen 30. The flow control device 12, in this example, is configured for producing the fluid 40 from a well. The well screen 30 filters sand, fines and/or debris from the fluid 40 prior to the fluid entering the flow control device 12.

From the well screen 30, the fluid 40 flows through an annular space 32 between generally tubular inner and outer housings 34, 36 of the flow control device 12. The fluid 40 can flow from the annular space 32 into the passage 20, unless the members 16 are sealingly engaged with the seats 22.

Figure 3:
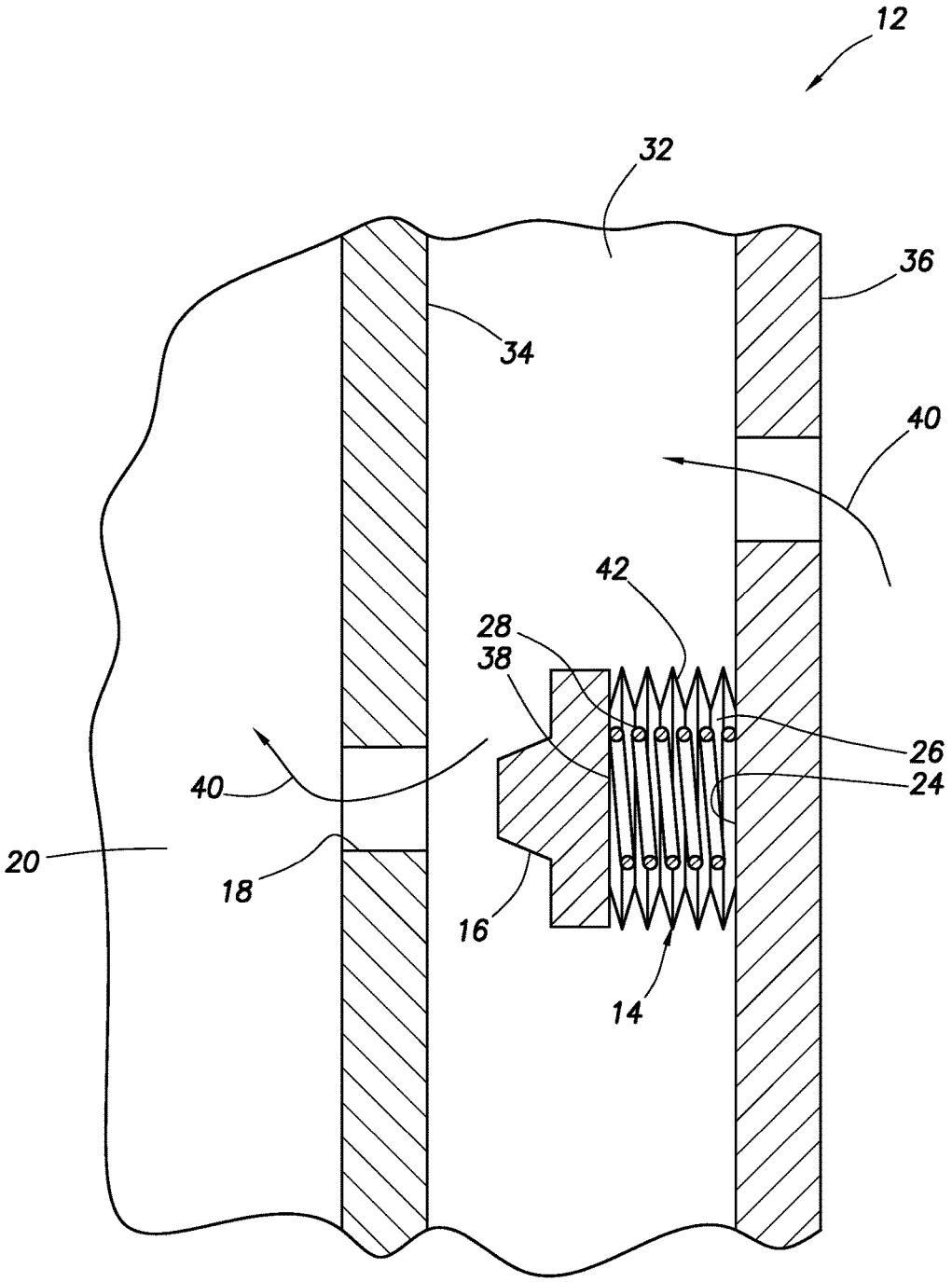
FIG. 3 is a representative cross-sectional view of a portion of another example of the flow control device.

Referring additionally now to FIG. 3, an enlarged cross-sectional view of one set of the actuator 14, flow restricting member 16 and opening 18 is representatively illustrated. In this example, the seat 22 is not used, and the fluid 40 is not filtered prior to flowing into the flow control device 12.

In the FIG. 3 example, the actuator 14 includes a chamber 24, with water 26 in the chamber. A biasing device 28 (such as, a compression spring) in the chamber 24 applies an outwardly biasing force to a wall 38 of the chamber, thereby reducing pressure in the chamber. The chamber 24 is bounded by a bellows 42, so that a volume of the chamber is readily variable.

When the water 26 in the chamber 24 boils, it expands, increasing pressure in the chamber, causing the volume of the chamber to increase, and thereby displacing the flow restricting member 16 toward the opening 18. If the chamber 24 volume increases sufficiently, the member 16 can engage the opening 18 (or seat 22, see FIG. 2) and block flow through the opening (at least substantially restricting such flow).

When the water 26 in the chamber 24 condenses, it decreases in volume, decreasing pressure in the chamber, causing the chamber volume to decrease, and thereby allowing the member 16 to displace away from the opening 18 (due to pressure in the annular space 32). Thus, flow of the fluid 40 is less restricted as the water 26 cools below its boiling point.

Since the pressure in the chamber 24 is less than pressure in the annular space 32 and on the exterior of the flow control device 12 (due to the force exerted by the biasing device 28), the water 26 in the chamber will boil before any water in the annular space or exterior to the flow control device boils. If the flow control device 12 is used for producing the fluid 40 from a formation in a steam injection operation (as discussed above), the increased restriction to flow resulting from the boiling of the water 26 in the chamber 24 can prevent (or at least substantially restrict) production of steam into the flow passage.

For example, if pressure in the chamber 24 is 25 psi (~172 kPa) less than pressure in the annular space 32, the water 26 in the chamber 24 will boil at a temperature about 5 degrees F. (~3 degrees C.) less than that at which water in the annular space will boil. Thus, the flow control device 12 will "close" (entirely or substantially preventing flow) prior to steam being present in the annular space 32 and exterior to the flow control device.

Referring additionally now to FIGS. 4A-F, a cross-sectional view of the flow control device 12 of FIG. 3 is representatively illustrated in various stages of operation, for purposes of explanation. However, it should be clearly understood that the scope of this disclosure is not limited to any particular stages of operation, or sequence of operation, of the flow control device 12.

Figure 4B:
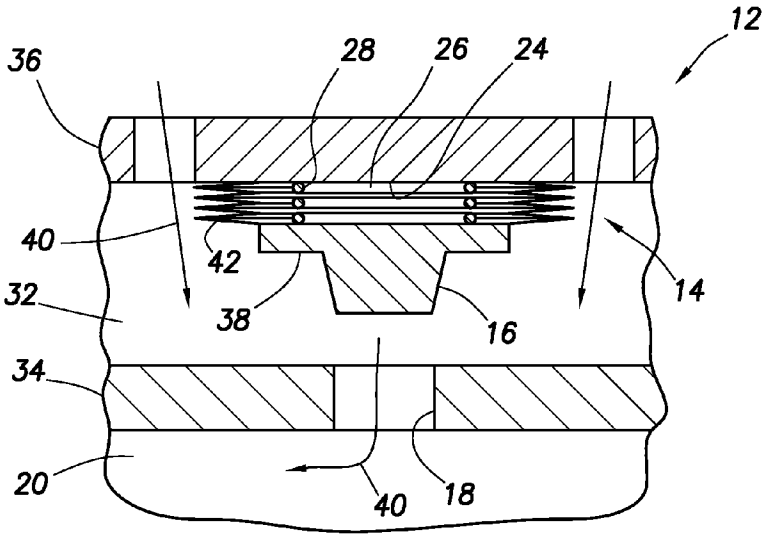
FIGS. 4A-F are representative cross-sectional views of the FIG. 3 flow control device in various operational stages.
Figure 4A:
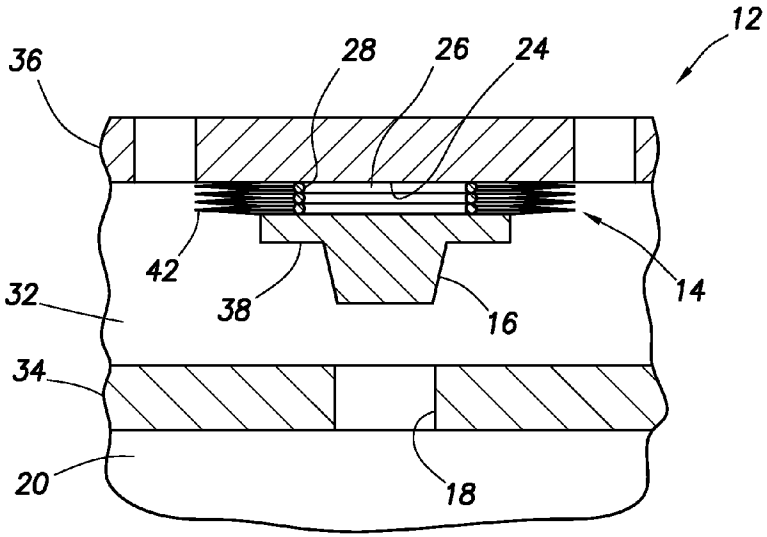

In FIG. 4A, the flow control device 12 is depicted at ambient conditions prior to installation in a well. For example, a temperature of the flow control device 12 may be 75 degrees F. (~24 degrees C.), pressure external to the flow control device (and in the annular space 32) may be ~15 psi (~1 bar), and pressure in the chamber 24 may be 10 psi (~69 kPa). The biasing device 28 maintains pressure in the chamber 24 less than pressure external to the actuator 14.

In this condition, the water 26 in the chamber 24 is in liquid phase. The member 16 is retracted away from the opening 18, and flow through the flow control device 12 is least restricted.

In FIG. 4B, the flow control device 12 is depicted after having been positioned in a well, such as, in a wellbore from which fluid is produced in a steam injection operation. For example, a temperature of the flow control device 12 may be 465 degrees F. (~240.6 degrees C.), pressure external to the flow control device (and in the annular space 32) may be 500 psi (~3.44 MPa), and pressure in the chamber 24 may be 495 psi (~3.41 MPa). The biasing device 28 still maintains pressure in the chamber 24 less than pressure external to the actuator 14.

In this condition, the water 26 in the chamber 24 is still in liquid phase, but has expanded somewhat (e.g., ~23%) due to thermal expansion. The member 16 is still retracted away from the opening 18, and flow of the fluid 40 through the flow control device 12 is not substantially restricted. The fluid 40 flows through the flow control device 12 into the passage 20 and is produced.

Figure 4D:
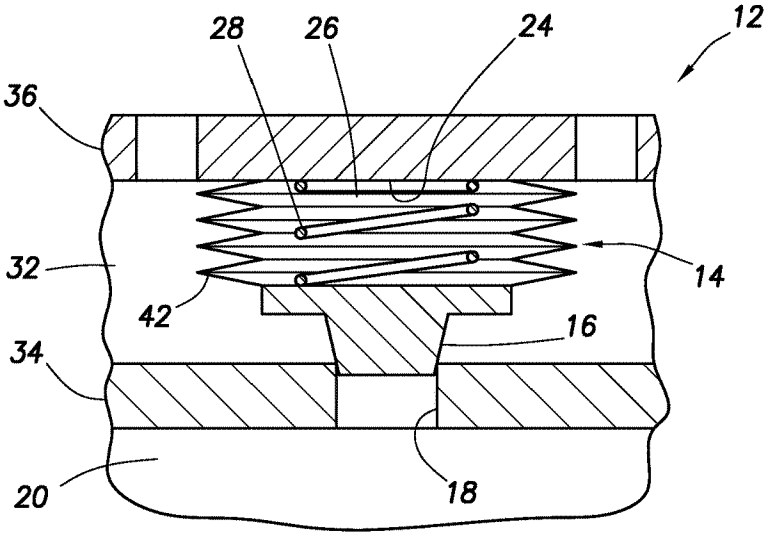
Figure 4C:
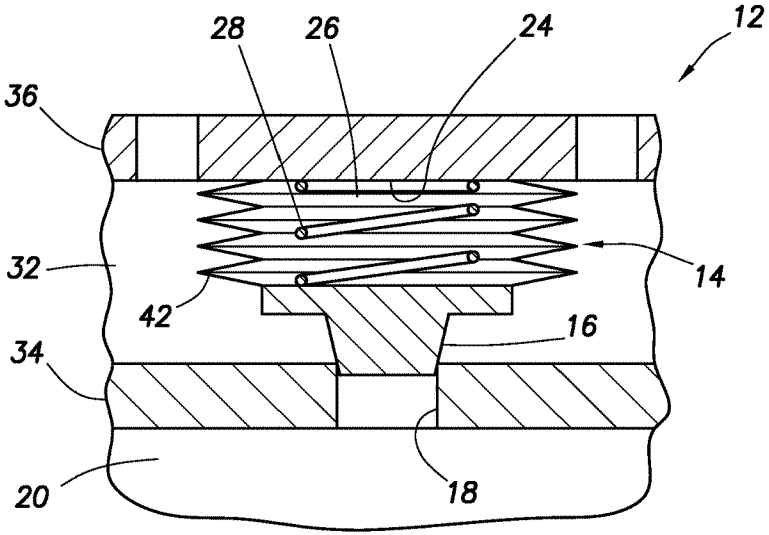

In FIG. 4C, the flow control device 12 is depicted after temperature in the well at the flow control device 12 has increased, such as, when steam approaches the wellbore in which the flow control device is positioned. For example, a temperature of the flow control device 12 may be 466 degrees F. (~241.1 degrees C.), pressure external to the flow control device (and in the annular space 32) may be 500 psi (~3.44 MPa), and pressure in the chamber 24 may be 495 psi (~3.41 MPa). The biasing device 28 still maintains pressure in the chamber 24 less than pressure external to the actuator 14.

In this condition, the water 26 in the chamber 24 boils, with a resulting increase in volume of the chamber. The biasing force of the biasing device 28 adds to the volume increase due to boiling of the water 26. This displaces the member 16 to a position in which the member blocks, or at least substantially blocks, flow through the opening. Flow of the fluid 40 through the flow control device 12 is substantially restricted, or entirely prevented.

In FIG. 4D, the flow control device 12 is depicted after temperature in the well at the flow control device 12 has increased further, such as, when steam enters the wellbore in which the flow control device is positioned. For example, a temperature of the flow control device 12 may be 467 degrees F. (~241.7 degrees C.), pressure external to the flow control device (and in the annular space 32) may be 500 psi (~3.44 MPa), and pressure in the chamber 24 may be 500 psi (~3.44 MPa). The biasing device 28 does not maintain pressure in the chamber 24 less than pressure external to the actuator 14 at this point, since the member 16 is in contact with the outer wall 34, and the volume of the chamber can no longer increase.

In this condition, the water 26 in the chamber 24 is in gaseous phase, as is any water in the annular space 32 and external to the flow control device 12. Flow of the fluid 40 through the flow control device 12 is substantially restricted, or entirely prevented. The flow control device 12 can be configured to entirely prevent flow of the fluid 40 at this condition (for example, by providing the seat 22 for sealing engagement with the member 16, or by providing another type of sealing device), if production of steam is to be entirely prevented.

Figure 4F:
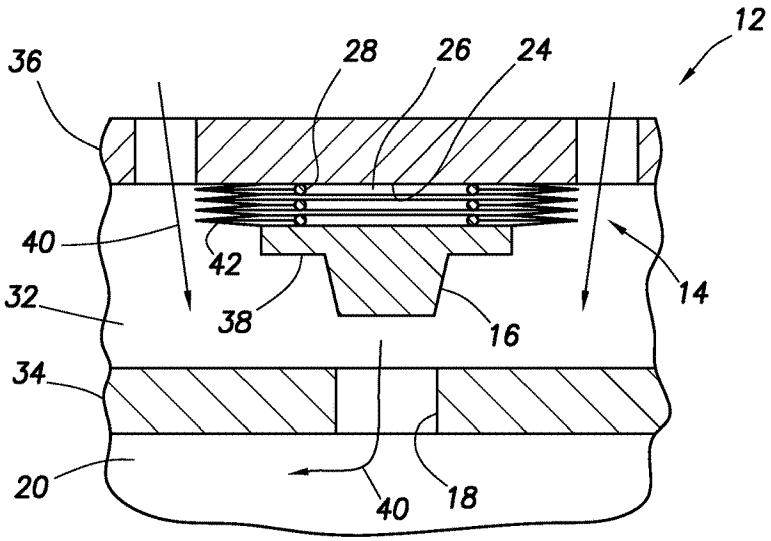
Figure 4E:
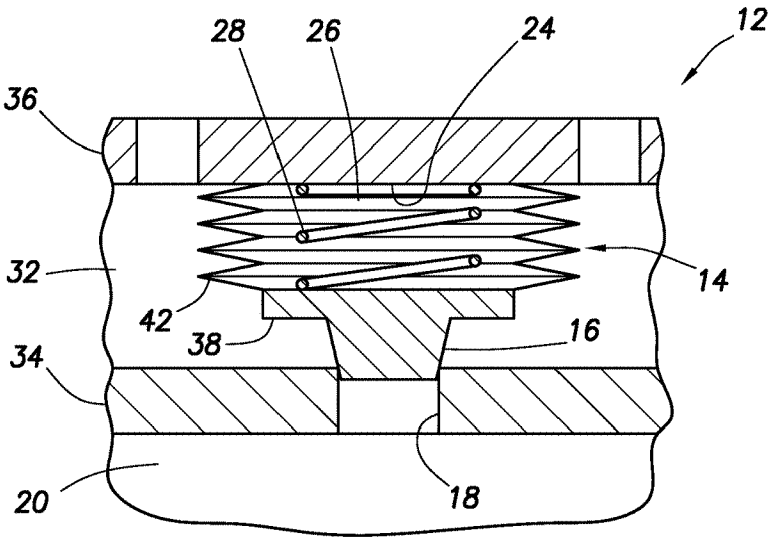

In FIG. 4E, the flow control device 12 is depicted after temperature in the well at the flow control device 12 has decreased, such as, when steam is no longer proximate the wellbore in which the flow control device is positioned. For example, a temperature of the flow control device 12 may be 466 degrees F. (~241.1 degrees C.), pressure external to the flow control device (and in the annular space 32) may be 500 psi (~3.44 MPa), and pressure in the chamber 24 may be 495 psi (~3.41 MPa). The biasing device 28 maintains pressure in the chamber 24 less than pressure external to the actuator 14.

In this condition, the water 26 in the chamber 24 is condensing, with a resulting decrease in pressure in the chamber. A pressure differential across the wall 38 of the chamber 24 biases the member 16 upward (as viewed in FIG. 4E), but a pressure differential across the member 16 (from the annular space 32 to the passage 20) can maintain the member engaged with the opening 18. Flow of the fluid 40 through the flow control device 12 remains substantially restricted, or entirely prevented.

In FIG. 4F, the flow control device 12 is depicted after the temperature has decreased sufficiently for the water 26 to be entirely in liquid phase. For example, a temperature of the flow control device 12 may be 462 degrees F. (~238.9 degrees C.), pressure external to the flow control device (and in the annular space 32) may be 500 psi (~3.44 MPa), and pressure in the chamber 24 may be 495 psi (~3.41 MPa). The biasing device 28 maintains pressure in the chamber 24 less than pressure external to the actuator 14.

In this condition, the member 16 is retracted away from the opening 18, and flow of the fluid 40 through the flow control device 12 is not substantially restricted. The fluid 40 flows through the flow control device 12 into the passage 20 and is produced.

Figure 5:
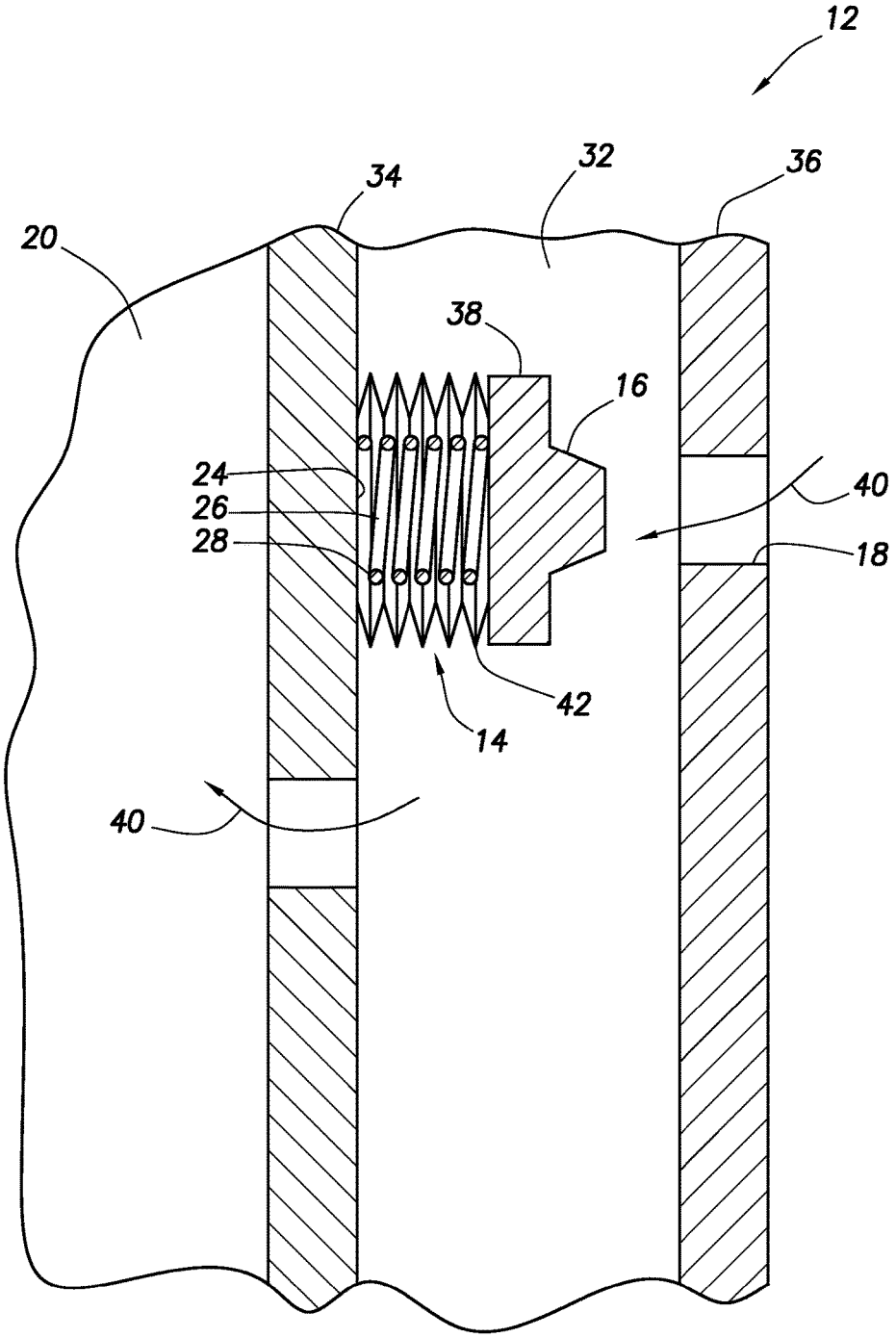
FIG. 5 is a representative cross-sectional view of another example of the flow control device.

Referring additionally now to FIG. 5, a cross-sectional view of another example of the flow control device 12 is representatively illustrated. In this example, when the flow control device 12 is "closed," a pressure differential across the member 16 (from the exterior of the flow control device to the annular space 32) will bias the member toward a more open position. This is in contrast to the FIGS. 2-4F example in which, when the flow control device 12 is "closed," the pressure differential across the member 16 (from the annular space 32 to the passage 20) will bias the member toward its "closed" position.

Thus, in the FIG. 5 example, the flow control device 12 will "open" more readily, but more force (produced by the pressure differential across the wall 38 of the chamber 24) will be needed to maintain the flow control device in its "closed" configuration (against the pressure differential across the member 16). This demonstrates that the scope of this disclosure is not limited to any particular configuration of the flow control device 12, since various configurations can be envisioned to accomplish desired results.

Figure 6:
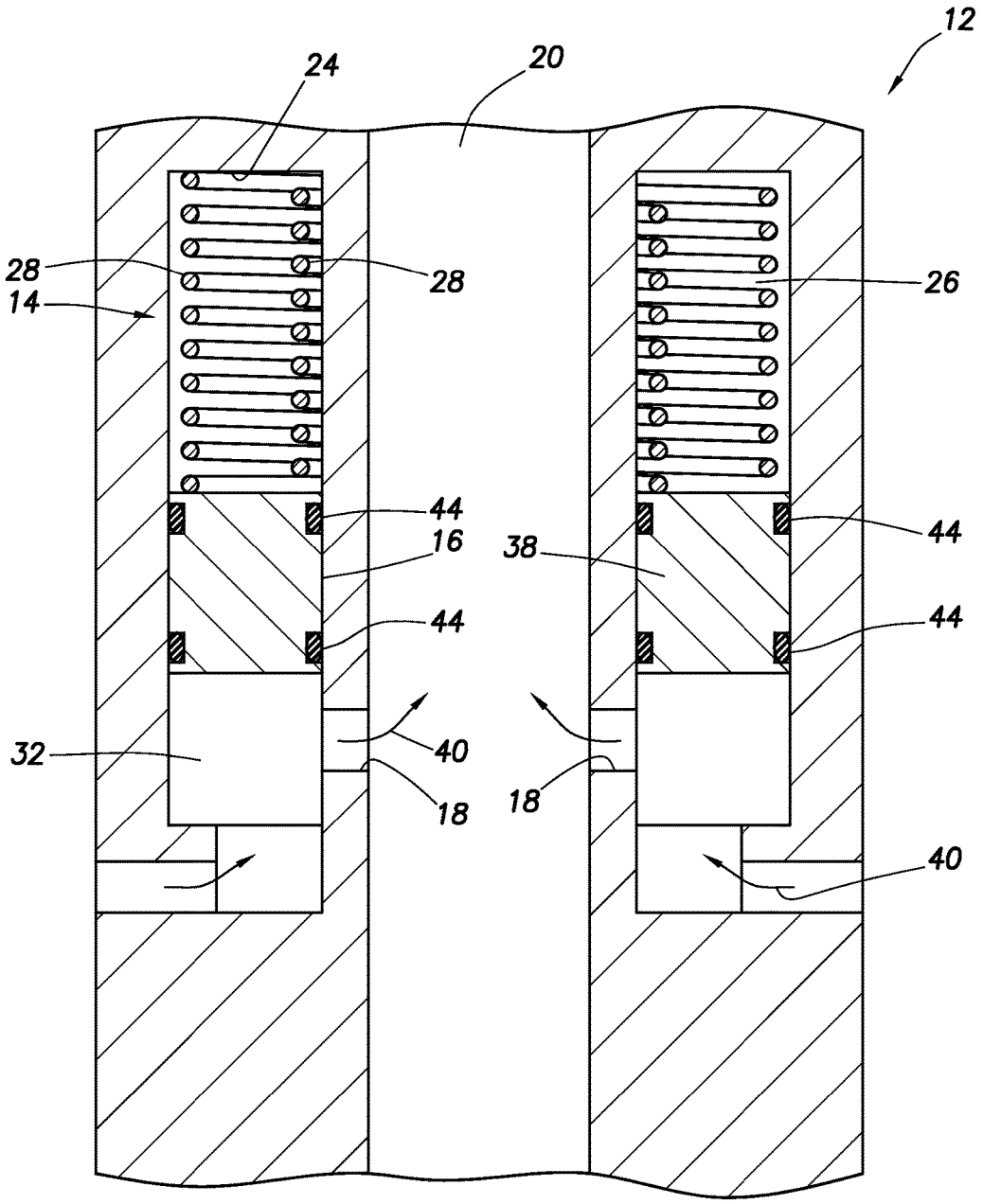
FIG. 6 is a representative cross-sectional view of another example of the flow control device.

Referring additionally now to FIG. 6, a cross-sectional view of yet another example of the flow control device 12 is representatively illustrated. In this example, the chamber 24 and wall 38 are in annular form, with the wall being in the form of a piston.

The piston blocks flow through the openings 18 when the volume of the chamber 24 increases sufficiently. Seals 44 on the piston can completely prevent such flow, if desired. If it is desired to substantially restrict, but not completely prevent, the flow, the lower set of seals 44 (as viewed in FIG. 6) may not be used.

The biasing devices 28 apply a biasing force to the wall 38, thereby reducing pressure in the chamber 24. The water 26 in the chamber 24 will, thus, boil at a temperature less than that at which water proximate the flow control device 12 (e.g., on an exterior of the flow control device, in the passage 20, or in the annular space 32) will boil.

Note that, in any of the examples of the flow control device 12 described above, the flow restricting member 16 could displace toward a less flow restricting position when the water 26 in the chamber 24 boils, and toward a more restricting position when the water in the chamber condenses. For example, suitably configured, the flow control device 12 can be "opened" when steam is present, and "closed" when steam is absent. As described more fully below, such a configuration can be useful to control injection of steam from a wellbore (e.g., by preventing injection of liquid water, but permitting injection of steam).

Although the examples of the flow control device 12 described above specifically include water 26 in the chamber 24, it is not necessary for water to be the only fluid in the chamber. For example, the water 26 could be combined with other fluids, such as, an azeotrope, a substance which increases a boiling point of the fluid(s) in the chamber, etc. The scope of this disclosure is not limited to use of any particular fluid, or combination of fluid(s) and/or substance(s) in the chamber 24.

Although the biasing device 28 in the above examples is in the form of a compression spring, other types of biasing devices may be used instead of, or in addition to, a spring. For example, a wall of the bellows 42 in the FIGS. 2-5 examples could be formed, so that it tends toward an extended configuration, thereby increasing a volume of the chamber 24 and reducing pressure in the chamber. This could be accomplished, for example, by annealing a metal bellows wall in its extended configuration, so that, when compressed, it "wants" to return to its extended configuration. Therefore, it should be understood that the scope of this disclosure is not limited to use of any particular type of biasing device.

The examples of the flow control device 12 described above can be used in methods of servicing a well which include using one or more of the devices to control the injection of fluid into, and/or the recovery of fluid from, the well. The well may include one or more wellbores arranged in any configuration suitable for injecting and/or recovering fluid from the wellbores, such as a steam-assisted gravity drainage (SAGD) configuration, a multilateral wellbore configuration, or a common wellbore configuration, etc.

A SAGD configuration typically comprises two independent wellbores with horizontal sections arranged one generally above the other. The upper wellbore may be used primarily to convey steam downhole, and the lower wellbore may be used primarily to produce oil. The wellbores may be positioned close enough together to allow for heat flux from one to the other. Oil in a reservoir adjacent to the upper wellbore becomes less viscous in response to being heated by the steam, such that gravity pulls the oil down to the lower wellbore where it can be produced.

Other suitable gravity drainage configurations use a grid of upper and lower horizontal wellbores which intersect each other. This configuration may be used, for example, to more effectively remove reservoir bitumen. The injection wellbores would still be spaced out above the production wellbores, although not necessarily directly vertically above the production wellbores. Use of the flow control device 12 would alleviate inherent steam distribution problems with this type of gravity drainage configuration.

A multilateral wellbore configuration can comprise two or more lateral wellbores extending from a single "parent" wellbore. The lateral wellbores are spaced apart from each other, whereby one wellbore may be used to convey steam downhole and the other wellbore may be used to produce oil. The multilateral wellbores may be arranged in parallel in various orientations (such as vertical or horizontal) and they may be spaced sufficiently apart to allow heat flux from one to the other.

In the common wellbore configuration, a same or common wellbore may be employed to convey steam downhole and to produce oil. The common wellbore may be arranged in various orientations (such as vertical or horizontal). Thus, it should be appreciated that the scope of this disclosure is not limited to any particular wellbore configuration.

Figure 7:
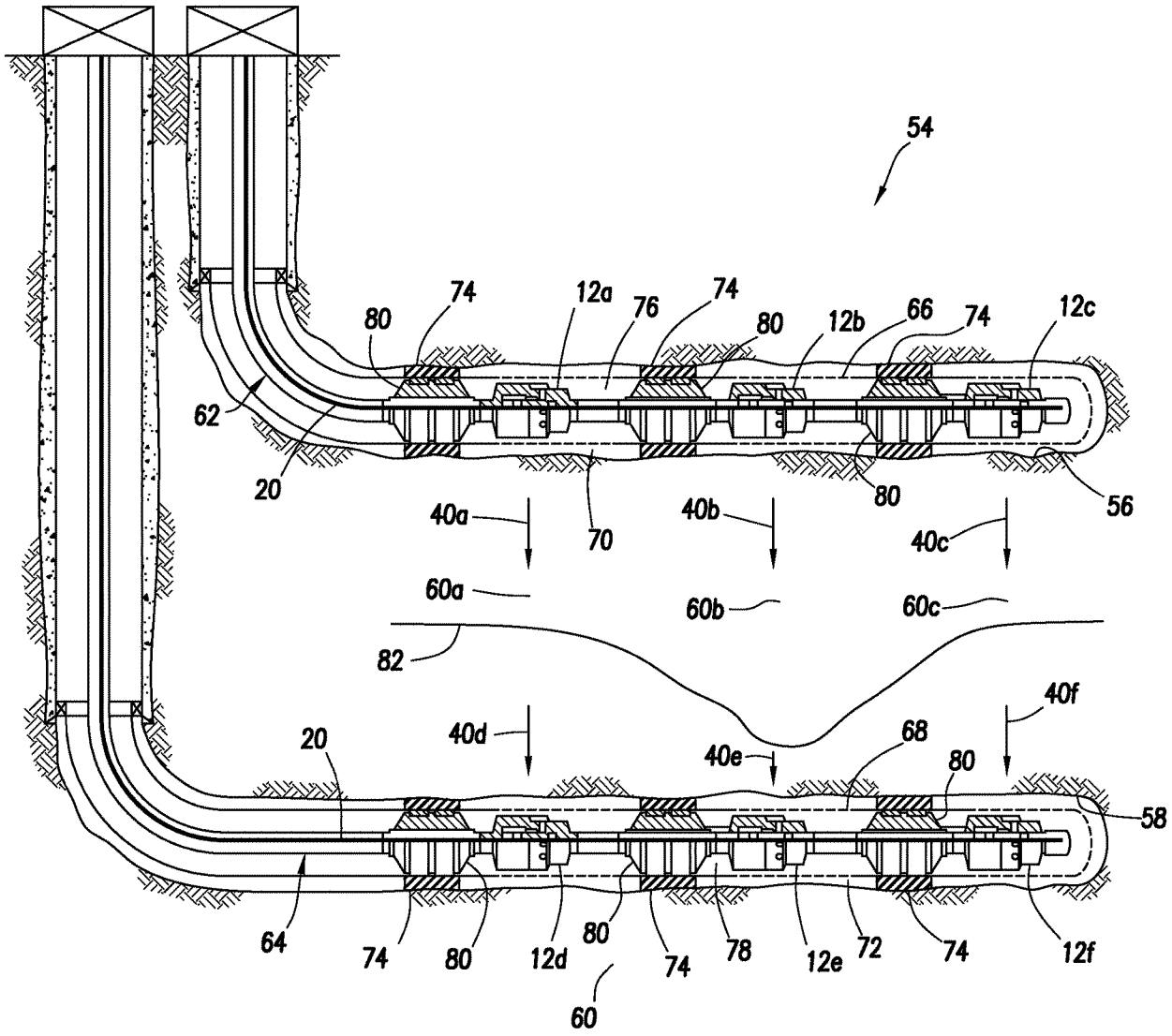
FIG. 7 is a representative partially cross-sectional view of a well system and method which can embody the principles of this disclosure.

Referring additionally now to FIG. 7, a well system 54 and associated method of controlling a phase of the fluid 40 when injected and produced in the well system are representatively illustrated. The well system 54 is of the type described above as a steam-assisted gravity drainage (SAGD) system.

The well system 54 includes two wellbores 56, 58. Preferably, the wellbore 58 is positioned vertically deeper in a formation 60 than the wellbore 56. In the example depicted in FIG. 7, the wellbore 56 is directly vertically above the wellbore 58, but this is not necessary in keeping with the principles of this disclosure.

A set of flow control devices 12*a-c*, 12*d-f* is installed in each of the respective wellbores 56, 58. The flow control devices 12*a-c*, 12*d-f* are preferably interconnected in respective tubular strings 62, 64, which are installed in respective slotted, screened or perforated liners 66, 68 positioned in open hole portions of the respective wellbores 56, 58.

Although only three of the flow control devices 12*a-c* and 12*d-f* are depicted in each wellbore in FIG. 7, any number of flow control devices may be used in keeping with the principles of the invention. The flow control devices 12*a-c* and 12*d-f* may be any of the flow control devices 12 described herein.

Zones 60*a-c* of the formation 60 are isolated from each other in an annulus 70 between the perforated liner 66 and the wellbore 56, and in an annulus 72 between the perforated liner 68 and the wellbore 58, using a sealing material 74 placed in each annulus. The sealing material 74 could be any type of sealing material (such as swellable elastomer, hardenable cement, selective plugging material, etc.), or more conventional packers could be used in place of the sealing material.

The zones 60*a-c* are isolated from each other in an annulus 76 between the tubular string 62 and the liner 66, and in an annulus 78 between the tubular string 64 and the liner 68, by packers 80 or another sealing material. Note that it is not necessary to isolate the zones 60*a-c* from each other in either of the wellbores 56, 58, and so use of the sealing material 74 and packers 80 is optional.

In the well system 54, steam is injected into the zones 60*a-c* of the formation 60 via the respective flow control devices 12*a-c* in the wellbore 56, and formation fluid (with the injected fluid) is received from the zones into the respective flow control devices 12*d-f* in the wellbore 58. Steam injected into the zones 60*a-c* is represented in FIG. 7 by respective arrows 40*a-c*, and fluid produced from the zones is represented in FIG. 7 by respective arrows 40*d-f*.

The flow control devices 12*a-c*, 12*d-f* in the wellbores 56, 58 are used to control a steamfront profile 82 in the formation 60. The steamfront profile 82 indicates the extent to which the injected fluid 40*a-c* remains in its gaseous phase. By controlling the amount of fluid 40*a-c* injected into each of the zones 60*a-c*, and the amount of fluid 40*d-f* produced from each of the zones, a shape of the profile 82 can also be controlled.

For example, if the steam is advancing too rapidly in one of the zones (as depicted in FIG. 7 by the dip in the profile 82 in the zone 60*b*), the steam injected into that zone may be shut off or choked, or production from that zone may be shut off or choked, to thereby prevent steam breakthrough into the wellbore 58, or at least to achieve a desired shape of the steamfront profile 82.

In the example of FIG. 7, the flow control device 12*b* in the wellbore 56 could be selectively closed or choked to stop or reduce the flow of the steam 40*b* into the zone 60*b*. Alternatively, or in addition, the flow control device 12*e* in the wellbore 58 could be selectively closed or choked to stop or reduce production of the fluid 40*e* from the zone 60*b*.

The restriction to flow through each of the flow control devices 12*a-c* and 12*d-f* can be automatically and independently varied, in order to maintain the fluid 40*a-c* and 40*d-f* in its gaseous phase until just prior to its production from the formation 60, to provide a desired quantitative distribution of steam along the injection wellbore 56, to provide a desired quantitative distribution of fluid 40*d-f* production along the wellbore 58, and/or to provide a desired temperature distribution in the formation 60, etc.

The flow control devices 12*a-c* can be configured so that they open (or choke flow less) when the steam 40*a-c* is present in the flow passage 20 of the tubular string 62. This can prevent, or at least substantially restrict, flow of liquid water into the formation from the wellbore 56, for example, during start-up and prior to the steam reaching the flow control devices 12*a-c*.

This can be accomplished by configuring each of the actuators 14 of the flow control devices 12*a-c* so that the flow control devices open (or choke flow less) when pressure and temperature at the respective flow control device correspond to a gaseous phase of water. For example, the boiling point of the water 26 in the chamber 24 can be greater than that of water in the flow passage 20 (e.g., by mixing with the water in the chamber a substance that increases the boiling point of the water), so that the flow control device opens (or chokes flow less) when the water in the chamber boils.

The flow control devices 12*d-f* can be configured so that they close (or choke flow more) when the steam 40*a-c* approaches the wellbore 58. This can prevent, or at least substantially restrict flow of steam from the formation, so that only (or substantially only) liquid water is produced.

This can be accomplished by configuring each of the actuators 14 of the flow control devices 12*d-f* so that the flow control devices close (or choke flow more) when pressure and temperature at the respective flow control device are close to a gaseous phase of water (such as, at a point along the curve G depicted in FIG. 1B). For example, the boiling point of the water 26 in the chamber 24 can be less than that of water in the annulus 72 (e.g., by virtue of the biasing device 28 reducing pressure in the chamber), so that the flow control device closes (or chokes flow more) when the water in the chamber boils.

Note that the well system 54 is only one of many well systems which may benefit from the principles described in this disclosure. Therefore, it should be clearly understood that the principles of this disclosure are not limited in any way to the details of the well system 54 and its associated method.

For example, it is not necessary for the flow control devices 12*a-c* and 12*d-f* to be used in both of the wellbores 56 and 58. The flow control devices 12*d-f* could be used in the production wellbore 58 without also using the flow control devices 12*a-c* in the injection wellbore 56, and vice versa.

Figure 8:
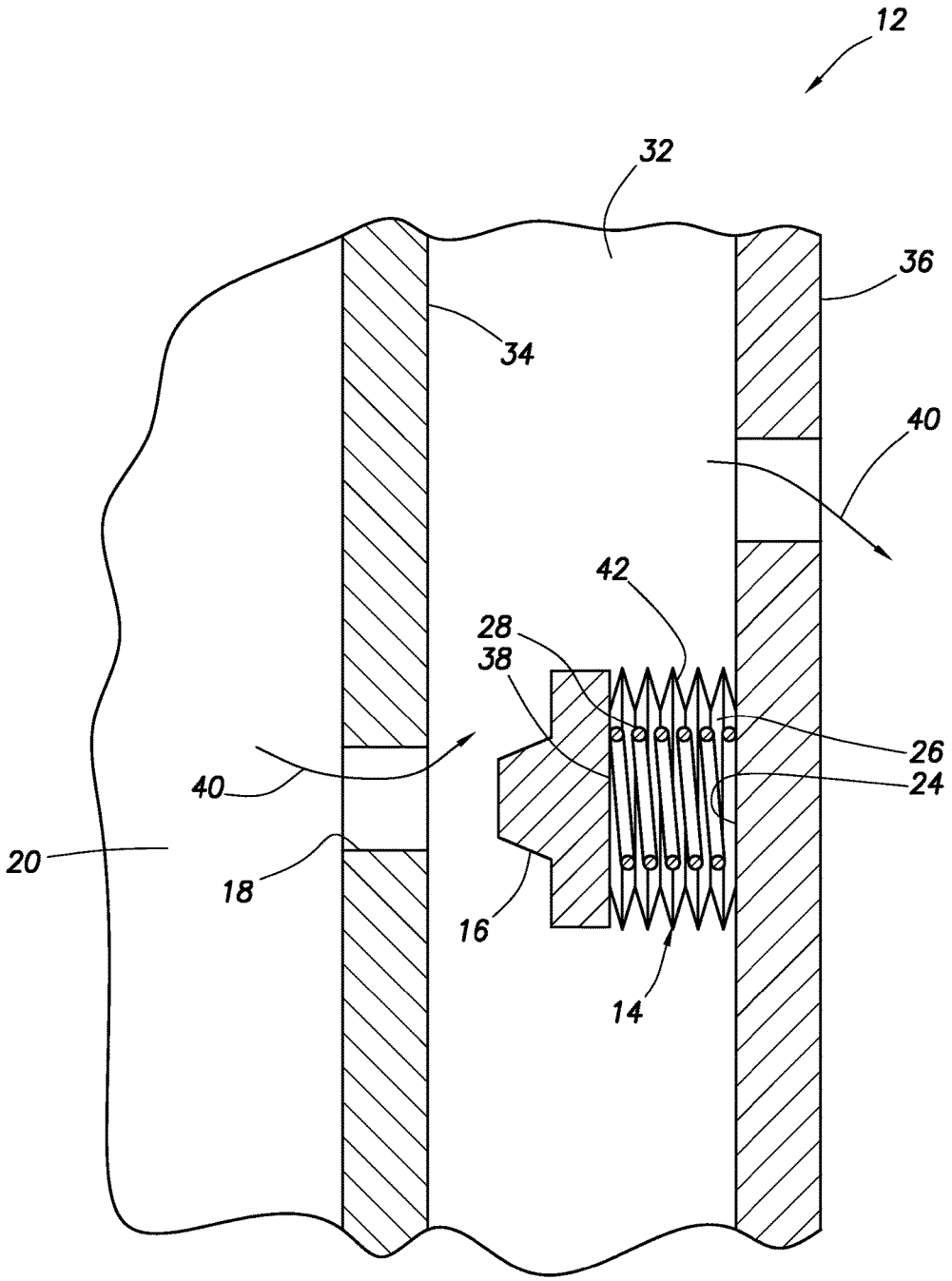
FIG. 8 is a representative cross-sectional view of another example of the flow control device.

Referring additionally now to FIG. 8, another example of the flow control device 12 is representatively illustrated. The flow control device 12 of FIG. 8 is similar to the example of FIG. 3, but differs at least in that the fluid 40 flows outward from the passage 20 to the annular space 32 and thence to the exterior of the flow control device.

Thus, the FIG. 8 flow control device 12 is suitable for use as the flow control devices 12*a-c* in the FIG. 7 well system 54. Of course, the FIG. 8 flow control device 12 can be used in other well systems, in keeping with the principles of this disclosure.

In the FIG. 8 example, the actuator 14 can be exposed to pressure less than that in the passage 20 (e.g., due to flow restriction at the opening 18. The actuator 14 can be configured to "close" the flow control device 12 at a predetermined offset from the liquid-gas phase change curve E (see FIGS. 1A & B). The amount of restriction can be adjusted by varying the seat 22 (see FIG. 2) or opening 18 area, the wall 38 area and/or the biasing force exerted by the biasing device 28.

For example, it may be desired for the flow control device 12 to "close" if excessive steam is being flowed through the device, in order to cause more steam to be injected via other flow control devices. This will function to even out the steam injection among multiple flow control devices 12. Other objectives can include distributing saturated steam and/or liquid along a wellbore, restricting free flow of superheated steam at hot spots along an injection wellbore, reducing restriction on saturated steam and/or liquid, and supplementing effects of using inflow control devices to promote more even distribution with potentially lower pumping losses.

Figure 9:
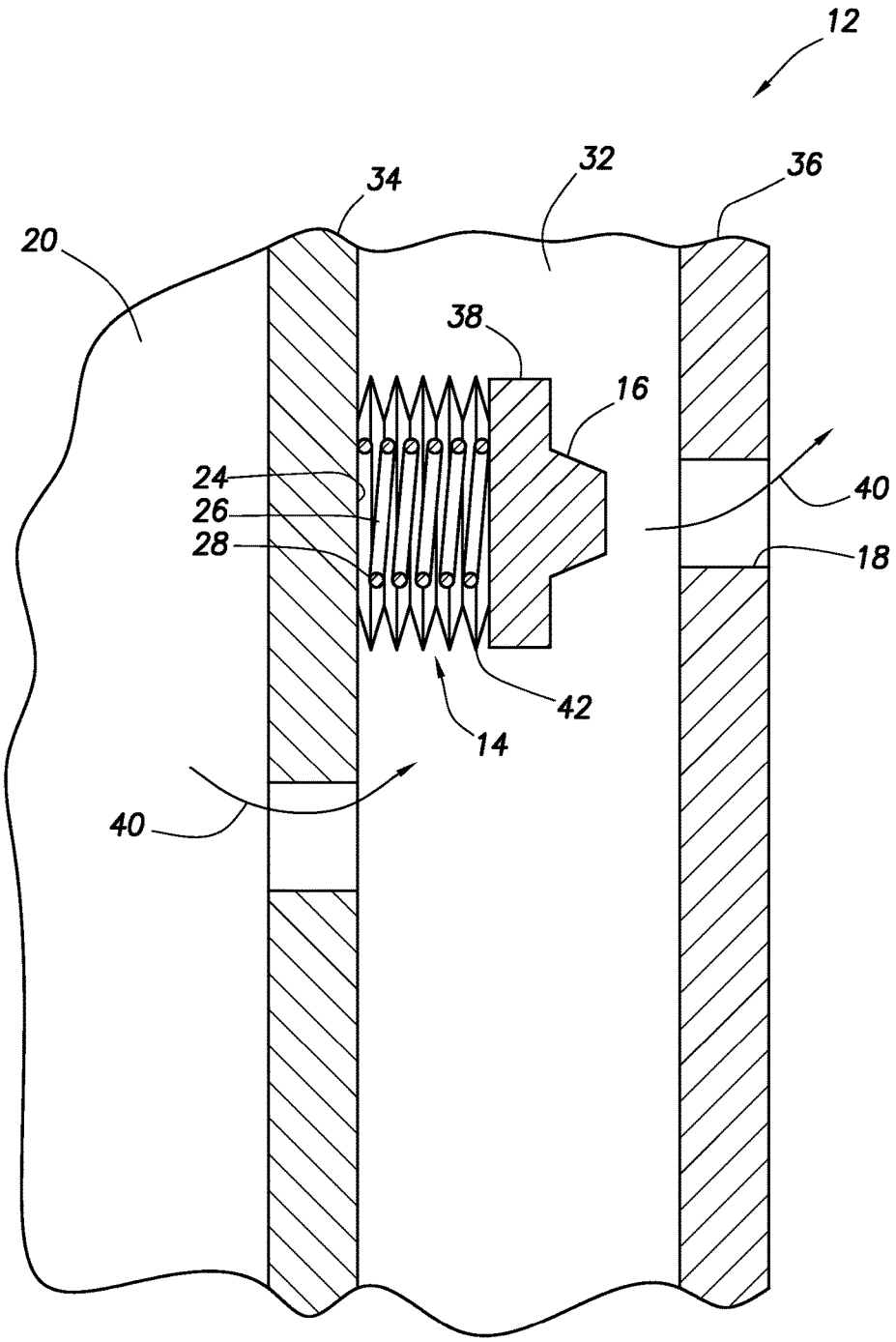
FIG. 9 is a representative cross-sectional view of another example of the flow control device.

Referring additionally now to FIG. 9, another example of the flow control device 12 is representatively illustrated. The flow control device 12 of FIG. 9 is similar to the example of FIG. 5, but differs at least in that the fluid 40 flows outward from the passage 20 to the annular space 32 and thence to the exterior of the flow control device.

Thus, the FIG. 9 flow control device 12 is suitable for use as the flow control devices 12*a-c* in the FIG. 7 well system 54. Of course, the FIG. 9 flow control device 12 can be used in other well systems, in keeping with the principles of this disclosure.

The FIG. 9 flow control device 12 can be used to block flow of steam at a predetermined offset from the liquid-gas phase change curve E of FIGS. 1A & B. For example, if the heat at a formation into which steam is being injected allows local well pressure at the flow control device 12 to decrease (e.g., because produced fluid has insufficient viscosity and local pressure loss is too low), the flow control device 12 will block further steam injection locally, until conditions change (e.g., local well pressure increases and local well temperature decreases).

If the low well pressure condition exists along a majority of the injector well, resulting in restriction to flow through multiple flow control devices 12, that would affect the pressure (and possibly temperature) in the passage 20. This may result in the flow control devices 12 staying "open" as design conditions are satisfied.

Figure 10:
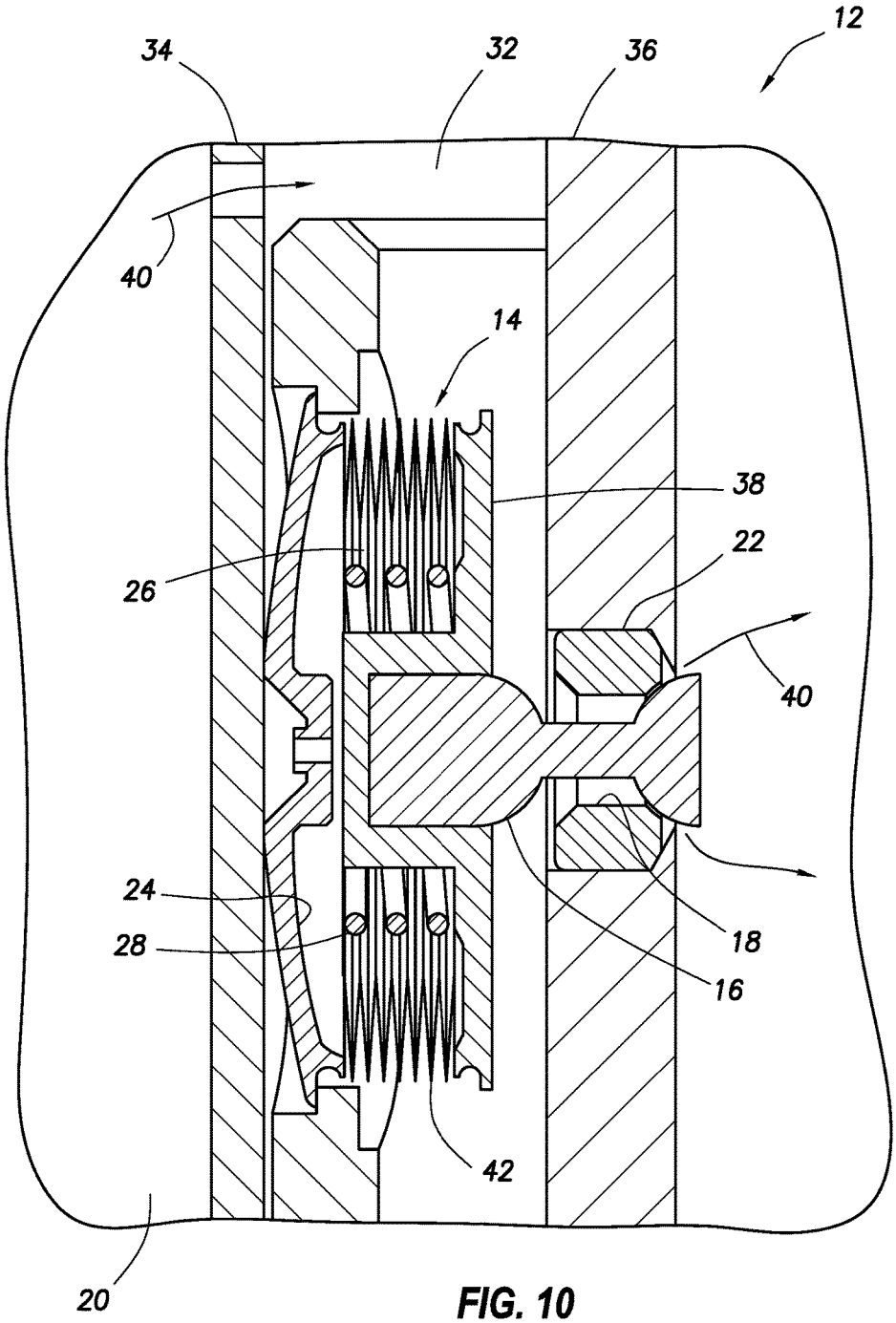
FIG. 10 is a representative cross-sectional view of another example of the flow control device.

Referring additionally now to FIG. 10, another example of the flow control device 12 is representatively illustrated. In this example, the flow restricting member 16 can engage the seat 22 and increasingly restrict flow through the opening 18 (or entirely prevent such flow) when the water 26 in the chamber 24 is in liquid phase, and when the water is in gaseous phase.

For example, the flow control device 12 of FIG. 10 can "open" (or choke flow less) when the water 26 in the chamber 24 boils, expanding the bellows and displacing the flow restricting member 16 out of sealing engagement with the seat 22. This function could be useful, for example, if the flow control device 12 is used to control injection of the fluid 40 (so that the fluid is not injected, unless it has reached a desired temperature and/or phase).

Prior to the flow control device 12 "opening," it can serve as a pressure relief valve, since a predetermined increased pressure in the annular space 32 can serve to push the flow restricting member 16 off of the seat 22 to allow flow of the fluid 40 through the opening 18. Such a pressure relief function can be useful to aid in balancing injection rates among multiple injection zones.

In addition, the flow control device 12 of FIG. 10 can "close" (or choke flow more) when pressure and temperature conditions are such that the fluid 40 is superheated (for example, to prevent injection of superheated steam, to provide for more even distribution of steam injection, etc.), with the bellows expanding further and displacing the flow restricting member 16 into sealing engagement with the seat 22. Thus, the flow control device 12 can permit relatively unrestricted flow of saturated steam, but prevent or restrict flow of superheated steam.

As the temperature decreases and/or the pressure increases, the flow control device 12 could then "open" again (e.g., to permit relatively unrestricted flow of saturated steam). Further temperature decrease and/or pressure increase causing the water 26 in the chamber 24 to condense can result in the flow control device 12 "closing" again (e.g., to prevent or restrict injection of liquid water).

Note that, in any of the examples of the flow control device 12 described above, pressure in the chamber 24 can be above or below the liquid-gas phase change curve E of FIGS. 1A & B. The biasing device 28 can increase or decrease the pressure as desired. The biasing force exerted by the biasing device 28 can be varied as a function of displacement of the wall 38 to facilitate desired operation of the actuator 14.

In some examples, the biasing force can transition between positive and negative. This provides for further fine tuning of the actuator 14 response to changes in pressure, temperature and pressure differential at the flow control device 12.

It may now be fully appreciated that the above disclosure provides significant advances to the art of constructing and operating flow control devices to control a phase of fluid flow in a well. In some examples described above, water 26 is disposed in a chamber 24 having a variable volume. A biasing device 28 reduces pressure in the chamber 24.

More specifically, the above disclosure provides to the art a flow control device 12 which, in one example, comprises: water 26 in a chamber 24, the chamber 24 having a variable volume; a flow restricting member 16 which displaces in response to a change in the chamber 24 volume; and a biasing device 28 which reduces a pressure in the chamber 24.

The biasing device 28 may bias a wall 38 of the chamber 24 outward.

The biasing device 28 may apply a biasing force which increases the chamber 24 volume.

The biasing device 28 may comprise a spring in the chamber 24.

The biasing device 28 may comprise a wall of the chamber 24 (such as, a wall of the bellows 42).

The chamber 24 may be disposed within a bellows 42.

The flow restricting member 16 may vary a restriction to flow through the flow control device 12, in response to the change in the chamber 24 volume.

In some examples, only a single fluid may be disposed in the chamber 24, with the water 26 being the single fluid. In some examples, no azeotrope may be disposed in the chamber 24.

An increase in the chamber 24 volume may displace the flow restricting member 16 to a position in which the flow restricting member 16 blocks flow through the flow control device 12. In other examples, a decrease in the chamber 24 volume may displace the flow restricting member 16 to a position in which the flow restricting member 16 blocks flow through the flow control device 12.

Also described above is a method of controlling flow of steam 40*a-c* in a well. In one example, the method comprises: providing a flow control device 12 which varies a resistance to flow in the well, the flow control device 12 including a chamber 24 having a variable volume, water 26 disposed in the chamber 24, and a biasing device 28. The biasing device 28 increases the chamber 24 volume.

The flow control device 12 may increase the restriction to flow as the steam 40*a-c* approaches the flow control device 12 in the well. In other examples, the flow control device 12 may decrease the restriction to flow as the steam 40*a-c* approaches the flow control device 12 in the well.

Another example of a flow control device 12 is described above. In this example, the flow control device 12 can comprise: water 26 in a chamber 24, the chamber 24 having a variable volume; a flow restricting member 16 which displaces in response to a change in the chamber 24 volume; and a biasing device 28 which reduces a boiling point of the water 26 in the chamber 24.

Although various examples have been described above, with each example having certain features, it should be understood that it is not necessary for a particular feature of one example to be used exclusively with that example. Instead, any of the features described above and/or depicted in the drawings can be combined with any of the examples, in addition to or in substitution for any of the other features of those examples. One example's features are not mutually exclusive to another example's features. Instead, the scope of this disclosure encompasses any combination of any of the features.

Although each example described above includes a certain combination of features, it should be understood that it is not necessary for all features of an example to be used. Instead, any of the features described above can be used, without any other particular feature or features also being used.

It should be understood that the various embodiments described herein may be utilized in various orientations, such as inclined, inverted, horizontal, vertical, etc., and in various configurations, without departing from the principles of this disclosure. The embodiments are described merely as examples of useful applications of the principles of the disclosure, which is not limited to any specific details of these embodiments.

In the above description of the representative examples, directional terms (such as "above," "below," "upper," "lower," etc.) are used for convenience in referring to the accompanying drawings. However, it should be clearly understood that the scope of this disclosure is not limited to any particular directions described herein.

The terms "including," "includes," "comprising," "comprises," and similar terms are used in a non-limiting sense in this specification. For example, if a system, method, apparatus, device, etc., is described as "including" a certain feature or element, the system, method, apparatus, device, etc., can include that feature or element, and can also include other features or elements. Similarly, the term "comprises" is considered to mean "comprises, but is not limited to."

Of course, a person skilled in the art would, upon a careful consideration of the above description of representative embodiments of the disclosure, readily appreciate that many modifications, additions, substitutions, deletions, and other changes may be made to the specific embodiments, and such changes are contemplated by the principles of this disclosure. For example, structures disclosed as being separately formed can, in other examples, be integrally formed and vice versa. Accordingly, the foregoing detailed description is to be clearly understood as being given by way of illustration and example only, the spirit and scope of the invention being limited solely by the appended claims and their equivalents.

What is claimed is:

1. A method of controlling flow of steam in a well, the method comprising:

providing a flow control device which varies a resistance to flow in the well, the flow control device including a chamber having a variable volume, water disposed in the chamber, and a biasing device disposed within the chamber, wherein the biasing device biases a wall of the chamber outward and reduces a pressure of the chamber, wherein the biasing device exerts a biasing force which decreases the chamber volume.

2. The method of claim 1, wherein the flow control device increases the restriction to flow as the steam approaches the flow control device in the well.

3. The method of claim 1, wherein the flow control device decreases the restriction to flow as the steam approaches the flow control device in the well.

4. The method of claim 1, wherein the biasing device reduces a boiling point of the water in the chamber.

5. The method of claim 1, wherein only a single fluid is disposed in the chamber, the water being the single fluid.

6. The method of claim 1, wherein the biasing device exerts a biasing force which increases the chamber volume.

* * * * *